US005823400A

United States Patent [19]

Omori et al.

[11] Patent Number: 5,823,400

[45] Date of Patent: Oct. 20, 1998

[54] CONTAINER HAVING NOZZLE PLATE WITH ENGAGEMENT CANCELLATION

[75] Inventors: Toshiyuki Omori; Yoshinori Inagawa, both of Tokyo, Japan

[73] Assignee: Kao Corporation, Tokyo, Japan

[21] Appl. No.: 682,168

[22] Filed: Jul. 17, 1996

[30] Foreign Application Priority Data

Aug. 21, 1995 [JP] Japan ..... 7-211834
Apr. 16, 1996 [JP] Japan ..... 8-093771

[51] Int. Cl.[6] ..... B65D 88/54

[52] U.S. Cl. ..... 222/318; 222/321.9; 222/494

[58] Field of Search ..... 222/494, 321.7, 222/321.9, 318

[56] References Cited

U.S. PATENT DOCUMENTS

| | | | |
|---|---|---|---|
| 3,360,169 | 12/1967 | Susuki et al. . | |
| 3,843,028 | 10/1974 | Whitehead | 222/494 |
| 3,952,926 | 4/1976 | Nilson . | |
| 4,102,476 | 7/1978 | Loeffler . | |
| 4,133,457 | 1/1979 | Klassen | 222/494 X |
| 5,284,132 | 2/1994 | Geier . | |

FOREIGN PATENT DOCUMENTS

| | | |
|---|---|---|
| 0 363 172 | 4/1990 | European Pat. Off. . |
| 2 101 356 | 3/1972 | France . |
| 2 165 571 | 8/1973 | France . |
| 79 27 316 | 1/1980 | Germany . |
| 2 122 586 | 1/1984 | United Kingdom . |
| 2 198 418 | 6/1988 | United Kingdom . |
| WO 90/12652 | 11/1990 | WIPO . |
| WO 95/25600 | 9/1995 | WIPO . |

*Primary Examiner*—Gregory L. Huson
*Attorney, Agent, or Firm*—Oblon, Spivak, McClelland, Maier & Neustadt, P.C.

[57] ABSTRACT

A container is configured by: a container body having an opening; a plate member which is made of a deformable material and which has a cutaway portion disposed for the opening; and a nozzle formed on the container body. A plate member is attached to the nozzle. The nozzle has a nozzle hole communicated with the cutaway portion. The plate member has an engagement cancellation portion where the plate member can be disengaged from the nozzle in a direction which is directed not to the nozzle but to the container body. In the container, even when an abnormal state of a certain extent occurs, such as when the container body falls, a liquid in the container does not leak out and a liquid which has not been completely ejected and remains in a midway portion can be automatically returned into the container body.

6 Claims, 6 Drawing Sheets

CONTAINER HAVING NOZZLE PLATE WITH ENGAGEMENT CANCELLATION

BACKGROUND OF THE INVENTION

1. Field of the Invention

The invention relates to a container into which a liquid such as a liquid detergent, a softening agent, a bleaching agent, a shampoo, or a hair rinse is to be filled.

2. Description of Related Art

A container is known in which a cap with a hole is attached to the container body and a liquid is ejected by squeezing the container body by a hand.

In a container of this type, however, a liquid is simply caused to leak out in, for example, the case where the container body falls. Therefore, a lid is required. However, it is cumbersome to lift the lid in every use and put on the lid after use.

The liquid which has been ejected to a midway portion of the hole is left unejected to remain in the portion as it is. Consequently, there may occur such an occasion that with the passage of time the remaining liquid is solidified and subsequent ejection is disabled. This is applicable also to a container of the pump type.

SUMMARY OF THE INVENTION

It is an object of the invention to provide a container wherein, even when an abnormal state of a certain extent occurs, such as when the container body falls, a liquid in the container does not leak out and a liquid which has not been completely ejected and remains in a midway portion is automatically returned into the container body.

The object of the invention can be attained by a container which comprises: a container body; a plate member which has a cutaway portion disposed for an opening of the container body and which is made of a deformable material; and a nozzle which has a nozzle hole communicated with the cutaway portion of the plate member, the plate member being attached in such a manner that engagement of the plate member can be partly canceled.

Particularly, the object can be attained by a container which comprises: a container body; a plate member which has a cutaway portion disposed for an opening of the container body and which is made of a deformable material; and a nozzle which has a nozzle hole communicated with the cutaway portion of the plate member, the plate member being attached in such a manner that engagement of the plate member can be partly canceled, and configured so that, when the partial engagement cancellation occurs, the nozzle hole and an interior of the container body are communicated with each other via the partial engagement cancellation portion.

The object can be attained by a container which comprises: a container body; a plate member which has a cutaway portion disposed for an opening of the container body and which is made of a deformable material; and a nozzle which has a nozzle hole communicated with the cutaway portion of the plate member, the plate member being attached in such a manner that engagement of the plate member can be partly canceled in a direction which is directed not to the nozzle but to the container body, and configured so that, when the partial engagement cancellation occurs, the nozzle hole and an interior of the container body are communicated with each other via the partial engagement cancellation portion.

In the container, preferably, a tube communicated with the cutaway portion of the plate member is disposed in the container body, and a liquid in the container body can be ejected via the tube, the cutaway portion of the plate member, and the nozzle.

The object of the invention can be attained by a container which comprises: a container body; a pump mechanism which is attached to the container body; a plate member which has a cutaway portion disposed for a liquid ejection port of the pump mechanism and which is made of a deformable material; and a nozzle which has a nozzle hole communicated with the cutaway portion of the plate member, the plate member being attached in such a manner that engagement of the plate member can be partly canceled.

The object of the invention can be attained by a container which comprises: a container body; a pump mechanism which is attached to the container body; a plate member which has a cutaway portion disposed for a liquid ejection port of the pump mechanism and which is made of a deformable material; and a nozzle which has a nozzle hole communicated with the cutaway portion of the plate member, the plate member being attached in such a manner that engagement of the plate member can be partly canceled, and configured so that, when the partial engagement cancellation occurs, the nozzle hole and an interior of the container body are communicated with each other via the partial engagement cancellation portion.

The object of the invention can be attained by a container which comprises: a container body; a pump mechanism which is attached to the container body; a plate member which has a cutaway portion disposed for a liquid ejection port of the pump mechanism and which is made of a deformable material; and a nozzle which has a nozzle hole communicated with the cutaway portion of the plate member, the plate member being attached in such a manner that engagement of the plate member can be partly canceled in a direction which is directed not to the nozzle but to the container body, and configured so that, when the partial engagement cancellation occurs, the nozzle hole and an interior of the container body are communicated with each other via the partial engagement cancellation portion.

In order to simplify the structure, preferably, the pump mechanism comprises a cylindrical shaft which is to be pushingly displaced, an opening of an upper end of the shaft functions as the liquid ejection port, and a liquid return path communicated with the interior of the container body is formed at a position of the shaft which corresponds to the partial engagement cancellation portion of the plate member.

Preferably, the plate member has a dish-like section shape and comprises: a center portion where the cutaway portion is formed; and a peripheral portion which surrounds the center portion and is raised by a predetermined angle with respect to the center portion, a taper face portion corresponding to the peripheral portion of the plate member is formed inside the nozzle, and an inclination angle of the peripheral portion of the plate member in a natural state with respect to the center portion is smaller than the inclination angle of the taper face portion of the nozzle, thereby forming a configuration in which the peripheral portion of the plate member is pressingly contacted with the taper face portion of the nozzle and closes the liquid return path which is communicated with the nozzle hole and formed in the taper face portion. This configuration can cope with a phenomenon in which the recovery force of the plate member is lowered as a result of secular changes and the sealing becomes gradually insufficient. In other words, the plate member having the above-described structure is always acted upon by a stress such as a tension, with the result that, even when the recovery force is reduced, the reduction is compensated by the tension. Therefore, an excellent press contact state is always obtained so that a high sealing property is maintained for a long period.

Preferably, the cutaway portion of the plate member is a slit.

In a container configured as described above, when the container body is squeezed (in a container having a pump mechanism, the container body is pumped), the pressure of the interior of the container body is applied to the plate member and hence the plate member is deformed, with the result that the liquid in the container body is ejected to the outside through, for example, a route of the tube, the opened cutaway portion, and the nozzle. When the squeezing operation is stopped, the container body is returned to the original state by its recovering force. At the same time, also the plate member is returned to the original shape so that the cutaway portion is closed. When no countermeasure is taken, therefore, the liquid remaining in a midway portion of the nozzle is left as it is. By contrast, in the container of the invention, for example, the engagement of the plate member can be partly canceled in an inward direction by a negative pressure which is generated as a result of the recovery of the container body. Therefore, the nozzle hole and the interior of the container body are communicated with each other via the space where the partial engagement cancellation occurs, so that the liquid remaining in a midway portion of the nozzle is sucked and returned into the container body. As a result, there hardly occurs a trouble in which a liquid remaining in a nozzle is solidified so as to clog the nozzle.

Usually, the interior of the container body is isolated from the exterior by the plate member. Particularly in a container of the squeeze type, therefore, no liquid leakage occurs in an abnormal state of a certain extent such as the falling of the container body. Even when the container is splashed with water, the water cannot enter the interior of the container body, and hence a problem in that the liquid is diluted with the water is not produced.

DETAILED DESCRIPTION OF THE PREFERRED EMBODIMENTS

Embodiments of the invention will be described in detail with reference to the accompanying drawings.

Figure 1:
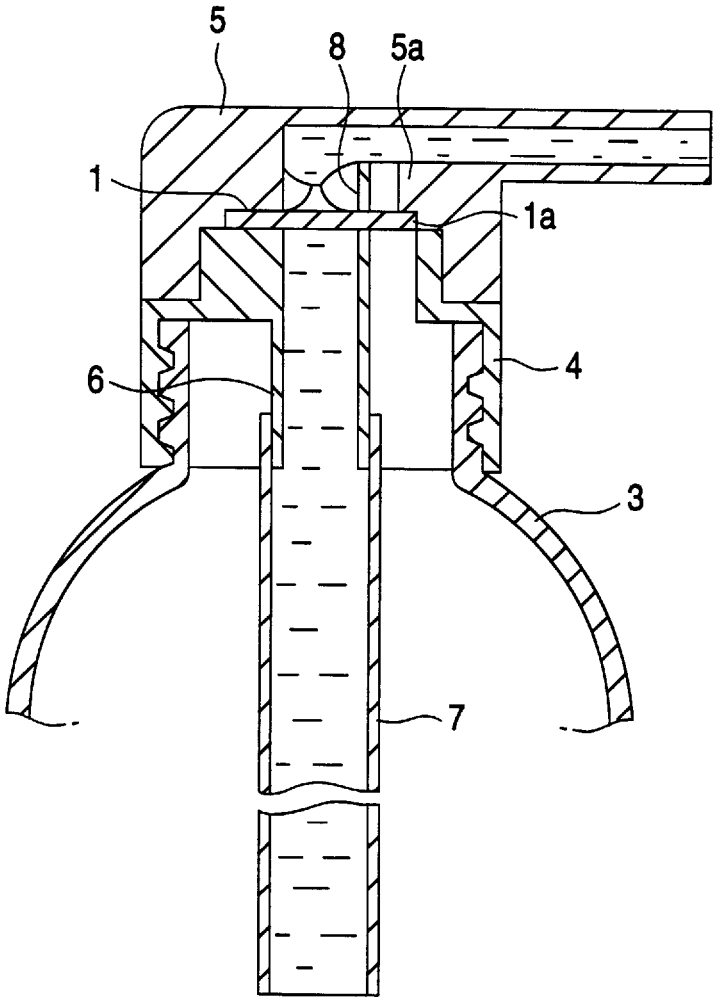
FIG. 1 is a section view of the main portions of a first embodiment of the container of the invention which is in a liquid ejection state.
Figure 2:
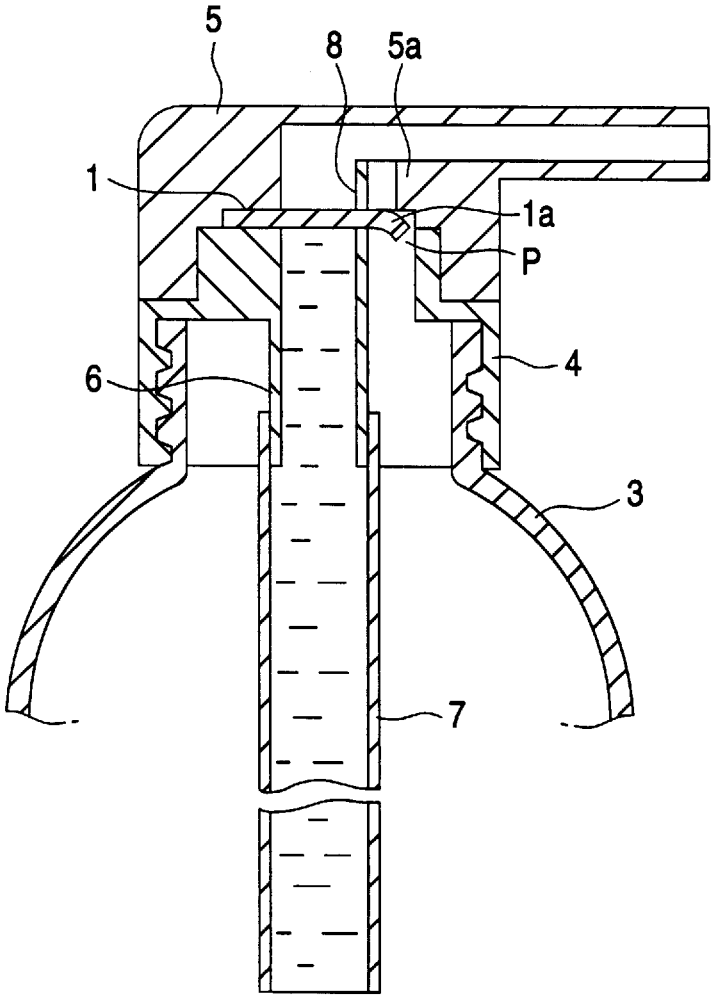
FIG. 2 is a section view of the main portions of the first embodiment of the container of the invention which is in a state after the liquid ejection.
Figure 3:
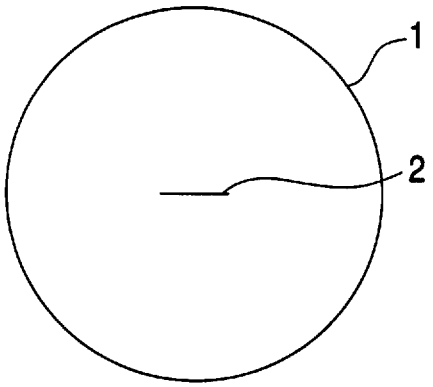
FIG. 3 is a plan view of a plate member used in the container of the first embodiment.

A first embodiment of the container of the invention will be described with reference to FIGS. 1 to 3. A plate member 1 is made of a flexible material such as a soft resin, an elastic material such as rubber, or a flexible and elastic material. In the embodiment, the plate member 1 is made of rubber which is flexible and elastic and is a disc plate having a thickness of 0.5 to 3 mm, for example, 2 mm. It is a matter of course that, depending upon the shape of the portion where the plate member is to be placed, the plate member may be rectangular or triangular. The plate member may have an additional projection.

A slit 2 is formed at an appropriate position of the plate member 1, for example, at the center of the plate member.

The container body 3 is made of a material which can be deformed by squeezing and then recovered.

A cap 4 is attached to an opening of the container body 3, and the plate member 1 is disposed at an opening which is formed in the upper portion of the cap 4.

A nozzle 5 is attached to the cap 4 so as to fixedly sandwich at least a part of the plate member 1. As seen from FIGS. 1 and 2, the plate member 1 is fixedly sandwiched by the cap 4 and the nozzle 5, and hence the plate member 1 is prevented from slipping off. In the configuration, however, a part 1*a* (the right end portion in FIGS. 1 and 2) of the plate member 1 is slightly contacted with one end of the cap 4. When the plate member 1 is acted upon by a suction force from a lower side (the interior of the container body 3), therefore, the plate member 1 is deformed so that the engagement between the part 1*a* of the plate member 1 and the end of the cap 4 is canceled. In other words, a passage P is formed in the portion where the partial engagement cancellation occurs. The engagement between the part 1*a* of the plate member 1 and the end of the cap 4 can be canceled by deformation of the plate member 1 directed to the interior of the container body 3 (directed downward), but the part 1*a* of the plate member 1 is engaged with a projection 5*a* of the nozzle 5 so that the plate member 1 is prevented from being deformed upward (toward the nozzle 5). In other words, when the container body 3 is squeezed, the part 1*a* of the plate member 1 is prevented from being disengaged from the end of the cap 4 toward the nozzle 5, or the passage P is prevented from being formed in the portion.

A pipe portion 6 hangs from the center portion of the cap 4. A tube 7 is connected to the pipe portion 6. The tube 7 is made of a flexible material and hangs to the lower portion of the interior of the container body 3.

A cylindrical guide portion 8 is configured on the nozzle 5.

In the thus configured container, the interior of the container body 3 is isolated from the exterior by the plate member 1 unless an external force is applied to the container body 3, and hence no liquid leakage occurs in an abnormal state of a certain extent such as the falling of the container body 3.

When the container body 3 is squeezed, the deformation of the container body causes the liquid in the container body 3 to rise in the tube 7 so as to press the plate member 1. At this time, the plate member 1 is pressed by a base portion of the nozzle 5, and hence the peripheral portion of the plate member 1 abuts against the end of the cap 4. Since the plate member 1 is subjected to the deformation pressure, however, the slit 2 is opened. As a result, the liquid is ejected through the nozzle 5 as shown in FIG. 1.

In the ejection, since the plate member 1 is deformed with a slight delay from the operation of squeezing the container body 3, there seldom happens an accident in which the liquid in the container body 3 is unintentionally ejected to soil the circumference.

When the squeezing operation is stopped, the container body 3 is returned to the original state and a negative pressure is generated in the container body 3. As a result, as shown in FIG. 2, the part 1*a* of the plate member 1 is inward bent or deformed so that the engagement between the part 1*a* of the plate member 1 and the end of the cap 4 is canceled and the passage P is formed in the portion. This causes the major portion of the liquid remaining in the nozzle 5 to be sucked and returned into the container body 3 via the passage P. Therefore, a phenomenon in which the liquid remaining in the nozzle 5 is solidified so as to clog the nozzle does not occur.

In the above, the first embodiment having a structure in which a liquid is ejected by squeezing the container body has been described. Alternatively, the container body may be provided with a pump mechanism so that a constant amount of the liquid is supplied by a one-push operation. A container having such a structure will be described as a second embodiment with reference to FIGS. 4 to 6.

A base portion 10 which cooperate with cylinders and pistons described later to configure the pump mechanism is attached to an opening of the container body 9 by screwing.

A first cylinder 11 is integrated with the base portion 10. Through holes 11*a* are opened at predetermined intervals for example, intervals of 180° in the peripheral face of the first cylinder 11. A second cylinder 12 is fitted onto an annular projection 13 which is integrated with the bottom portion of the first cylinder 11. Particularly, the junction portion is provided with excellent airtightness by closely contacting the whole peripheral area of the second cylinder 12 with the annular projection 13.

A liquid introduction port 12*a* is formed in the bottom face of the second cylinder 12. A three-point suspension valve 14 is attached at that position. A soft tube (not shown) for sucking up the liquid in the container body 9 is connected to a conduit tube 12*b* continuous from the liquid introduction port 12*a*.

A first shaft 15 has a first ejection guide path 15*a* which is formed in the shaft, and is guided by the base portion 10 so as to be vertically displaceable. A first piston 16 having a through hole continuous from the first ejection guide path 15*a* is integrated with the lower end portion of the first shaft 15. The outer peripheral face of the first piston 16 is closely contacted with the inner peripheral face of the first cylinder 11, so that the first piston is displaceable while the airtightness of the interior of the first cylinder 11 is maintained.

In the first shaft 15, a first liquid return path 15*b* is formed in addition to the ejection guide path 15*a*. The first liquid return path 15*b* passes through the first piston 16.

A second shaft 17 has a second ejection guide path 17*a* which is formed in the shaft, and passes through the bottom portion of the first cylinder 11, i.e., the annular projection 13 while maintaining the airtightness. The second shaft 17 is fitted into the first shaft 15 so that the first and second ejection guide paths 15*a* and 17*a* constitute one continuous ejection guide path.

A second piston 18 having a through hole continuous from the second ejection guide path 17*a* is integrated with a lower end portion of the second shaft 17. The first and second pistons 16 and 18 are connected to each other by the second shaft 17. When one of the pistons is vertically moved, also the other piston is displaced in accordance with the movement.

A three-point suspension valve 19 is attached so as to correspond to the through hole at the center of the bottom face of the second piston 18.

A valve member 20 having a dish-like section shape is disposed so as to correspond to the liquid ejection port of the pump mechanism, i.e., the opening in the upper end of the first shaft 15 (the opening of the first ejection guide path 15*a*). As seen from FIG. 6, the valve member 20 consists of a disc-like center portion 20*a*, and a peripheral portion 20*b* which surrounds the center portion and is slantly raised. Preferably, the inclination angle θ of the peripheral portion 20*b* with respect to the center portion 20*a* is, for example, 0° to 60°. In the embodiment, the angle is set to be 45°.

In the center portion 20*a* of the valve member 20, a slit 21 of, for example, a straight-line shape is formed in an area opposing the opening of the first ejection guide path 15*a*.

The material configuring the valve member 20 is the same as that used in the first embodiment.

A nozzle 22 has an ejection pipe 22*a* which horizontally elongates. The nozzle 22 is attached to the upper end portion of the first shaft 15 with disposing the valve member 20 therebetween. In other words, the valve member 20 is vertically sandwiched between the nozzle 22 and the first shaft 15, and held between them. Only the center portion 20*a* is fixed so as not to be deformed, and the peripheral portion 20*b* is deformable.

An annular taper face portion 22*b* against which the peripheral portion 20*b* of the valve member 20 abuts is configured inside (in the lower portion of) the nozzle 22. A second liquid return path 23 which is communicated with the first liquid return path 15*b* branches off from the flow path in the nozzle 22, and opens in the taper face portion 22*b*.

The inclination angle of the taper face portion 22*b* is larger than the above-mentioned inclination angle of the peripheral portion 20*b* in a natural state, by, for example, about 5° to 10°. In the set state, therefore the peripheral portion 20*b* of the valve member 20 deflects until the inclination angle of the portion becomes equal to that of the taper face portion 22*b*, and is caused to be pressingly contacted with the taper face portion 22*b* by the resilient force generated in the deflection. In this way, the opening of the second liquid return path 23 is usually closed by the peripheral portion 20*b* of the valve member 20.

In the thus configured container, when the nozzle 22 is pushed down under the state where a liquid stays in the lower space of the second cylinder 12 (the state shown in FIG. 4), the pump mechanism is activated so that the liquid is ejected. Specifically, the pressure of the liquid in the second cylinder 12 is raised and first the three-point suspension valve 19 is opened (while the three-point suspension valve 14 remains to be closed). The liquid passes through the opened three-point suspension valve 19 and the first and second ejection guide paths 15*a* and 17*a*, and then through the slit 21 of the valve member 20 which is deformed by the liquid pressure, to be finally ejected from the nozzle 22.

The liquid in the first cylinder 11 (the liquid to be returned) is discharged from the through holes 11*a* by the lowering operation of the first piston 16, so as to be returned into the container body 9.

When the second piston 18 is lowered in the operation of ejecting the liquid, the gap between the upper end face of the piston and the lower end face of the annular projection 13 becomes larger, or a space which is in a substantially vacuum is formed in the second cylinder 12. Consequently, the second piston 18 is acted upon by an upward force due to the pressure difference between atmospheric pressure and the internal pressure of the substantially vacuum space. This appears as a reaction force (recovery force) acting against the force for pushing down the nozzle 22.

Figure 5:
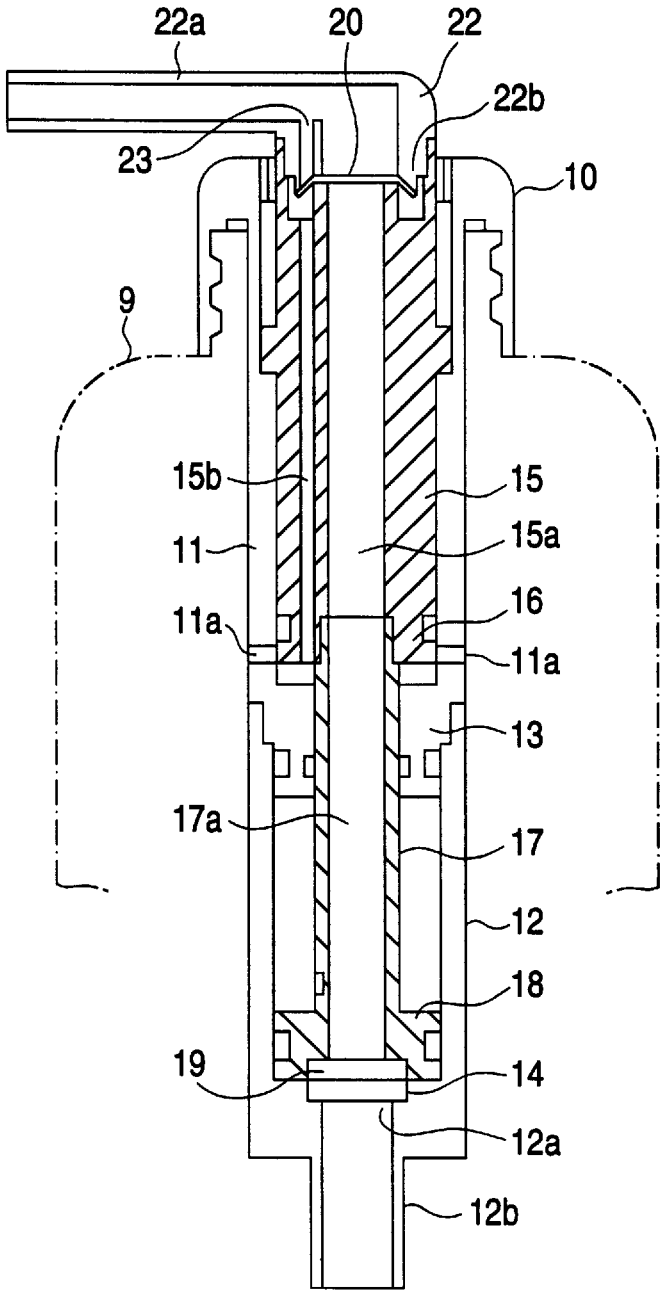
FIG. 5 is a section view of the main portions of the second embodiment of the container of the invention which is in a state after the liquid ejection.
Figure 6:
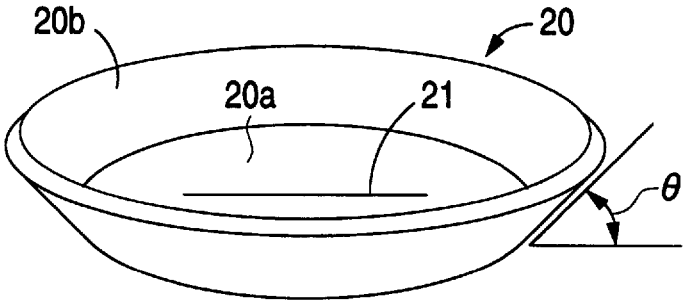
FIG. 6 is a perspective view of a valve element used in the container of the second embodiment.

When the nozzle 22 is pushed down to the final position with opposing the reaction force and the amount of the liquid corresponding to the one operation is ejected, the state shown in FIG. 5 is attained.

After the ejection of the liquid, the force applied to the nozzle 22 is released. Then the second piston 18 is pushed up to the original position by the recovery force. This causes the three-point suspension valve 14 to be opened (while the three-point suspension valve 19 remains to be closed) so that the liquid is sucked up from the interior of the container body 9 into the lower space of the second cylinder 12.

As the second piston 18 is raised, also the first piston 16 is raised, and hence a negative pressure is generated in the first cylinder 11. Then the valve member 20 is sucked so that the portion corresponding to the second liquid return path 23 is deformed, with the result that only the portion is separated from the taper face portion 22*b*.

The liquid which has not been ejected and remains in the nozzle 22 passes over the separated portion, and is then sucked into the first cylinder 11 via the first liquid return path 15*b*. Consequently, the liquid which remains in the nozzle 22 is prevented from dropping from the tip end of the ejection pipe 22*a*.

Figure 4:
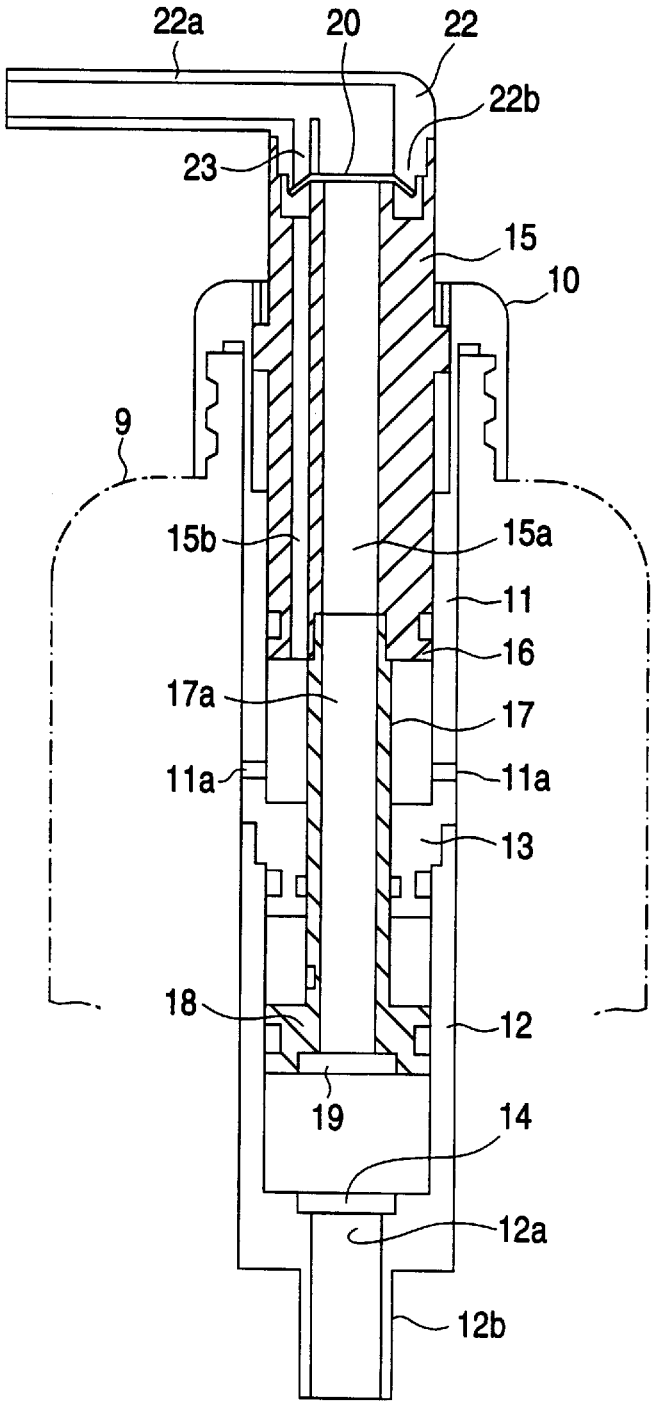
FIG. 4 is a section view of the main portions of a second embodiment of the container of the invention which is in a state before the liquid ejection.

At the timing when the second piston 18 is returned to the position where the piston was situated before the ejection of the liquid, or to the state of FIG. 4, the interior of the first cylinder 11 is returned to normal pressure and the suction force vanishes. The valve member 20 in which the application of the suction force disappears is again pressingly contacted with the taper face portion 22*b* so as to close the opening. Then the lower space of the second cylinder 12 is filled with the liquid which has been sucked up from the interior of the container body 9, and the preparatory state in which the ejection is enabled is again established.

Also in the second embodiment of the invention, in the same manner as the first embodiment, it is possible to attain an effect that a trouble in which the liquid remaining in the nozzle is solidified so as to clog the nozzle does not. Furthermore, the second embodiment can attain the following effects.

In the valve member made of an elastic material such as rubber, its elasticity is gradually reduced as a result of secular changes. This causes the sealing to become insufficient. In other words, isolation between the interior of the container body 9 and the exterior becomes imperfect. Under such a situation, the liquid in the container leaks in an abnormal state of a certain extent such as the falling of the container, or water easily enters the container body 9. In a configuration in which the valve member 20 having a dish-like section shape is set under a deformed state as described above, even when the elasticity is reduced, the reduction is compensated by the stress (tension) which always acts on the valve member 20. Therefore, the valve member 20 is always pressingly contacted with the taper face portion 22*b* of the nozzle 22 in which the opening communicated with the nozzle hole is formed, with the result that a high sealing property is maintained for a long period.

When a configuration is to be employed in which a valve member in a natural state closes an opening communicated with a nozzle hole, the opening and the valve member must be designed with high accuracy so that the clearance between them is exactly zero. By contrast, in the second embodiment, the valve member 20 is pressingly contacted by compulsion with the periphery of the opening. Therefore, high accuracy is not required so that the production cost is reduced.

According to the invention, even when an abnormal state of a certain extent occurs, such as when the container body falls, a liquid in the container does not leak out. After the liquid ejection, a liquid which has not been completely ejected and remains in a midway portion is returned into the container body. In the container, therefore, an accident in which such a remaining liquid is solidified so as to impede subsequent ejection does not occur. Consequently, the container is excellent in usability.

What is claimed is:

1. A container comprising:

a container body having an opening;

a plate member which is made of a deformable material and which has a cutaway portion disposed for supplying a liquid in the container body to said opening;

a nozzle disposed on said container body, said plate member being attached to said nozzle, said nozzle having a nozzle hole communicated with said cutaway portion, an engagement cancellation portion in said plate member where engagement between said plate member and said nozzle can be cancelled toward said container body; and means for communicating the liquid in the container body with said cutaway portion and not for communicating the liquid with said engagement cancellation portion.

2. A container according to claim 1, wherein, when the engagement cancellation occurs, said nozzle hole is communicated with an interior of said container body via said engagement cancellation portion.

3. A container according to claim 2, wherein, said plate member is attached so that said engagement cancellation portion is disengaged not toward said nozzle but toward said container body.

4. A container according to claim 1, wherein said cutaway portion constitutes a slit.

5. A container comprising:

a container body having an opening;

a plate member which is made of a deformable material and which has a cutaway portion disposed for said opening; and a nozzle disposed on said container body, said plate member being attached to said nozzle, said nozzle having a nozzle hole communicated with said cutaway portion, said plate member having an engagement cancellation portion where engagement between said plate member and said nozzle can be cancelled toward said container body;

wherein said container further comprises a pump mechanism which is attached to said opening of said container body, said pump mechanism having a liquid ejection port, said cutaway portion being disposed for said liquid ejection port, wherein said pump mechanism comprises a cylindrical shaft which is to be pushingly displaced and a liquid return path which is formed at a position of said shaft, said position corresponding to said engagement cancellation portion, said path being communicated with an interior of said container body, said shaft having an opening at an upper end which functions as said liquid ejection port.

6. A container comprising:

a container body having an opening;

a plate member which is made of a deformable material and which has a cutaway portion disposed for said opening; and a nozzle disposed on said container body, said plate member being attached to said nozzle, said nozzle having a nozzle hole communicated with said cutaway portion, said plate member having an engagement cancellation portion where engagement between said plate member and said nozzle can be cancelled toward said container body;

wherein said container further comprises a pump mechanism which is attached to said opening of said container body, said pump mechanism having a liquid ejection port, said cutaway portion being disposed for said liquid ejection port, wherein said plate member has a dish-like section shape and comprises a center portion where said cutaway portion is formed and a peripheral portion which surrounds said center portion and is raised by a predetermined angle with respect to said center portion, a taper face portion which is disposed so as to correspond to said peripheral portion is formed inside said nozzle, said taper face portion having a liquid return path which is communicated with said nozzle hole, and an inclination angle of said peripheral portion in a natural state with respect to said center portion is smaller than the inclination angle of said taper face portion, thereby causing said peripheral portion to be pressingly contacted with said taper face portion and close said liquid return path.

* * * * *